United States Patent [19]

Hendricks

[11] Patent Number: 4,729,180

[45] Date of Patent: Mar. 8, 1988

[54] QUICK TEETH BUCKET ATTACHMENT

[76] Inventor: Robert G. Hendricks, 2450 Ingold Ct., Green Bay, Wis. 54303

[21] Appl. No.: 860,565

[22] Filed: May 7, 1986

[51] Int. Cl.[4] ..... E02F 9/28

[52] U.S. Cl. ..... 37/141 T; 37/141 R; 37/117.5; 37/DIG. 3; 37/DIG. 12

[58] Field of Search ..... 37/141 T, 141 R, 142 R, 37/117.5, DIG. 3, DIG. 12

[56] References Cited

U.S. PATENT DOCUMENTS

| | | | |
|---|---|---|---|
| 3,097,439 | 7/1963 | Calkin | 32/117.5 |
| 3,478,449 | 11/1969 | Baker | 37/117.5 X |
| 3,595,416 | 7/1971 | Perrotti | 37/117.5 X |
| 3,834,567 | 9/1974 | Miller | 37/141 T X |
| 3,896,569 | 7/1975 | Thompson et al. | 37/141 T |
| 3,975,844 | 8/1976 | Olson | 32/DIG. 3 |
| 4,151,664 | 5/1979 | Maura | 37/117.5 |
| 4,407,080 | 10/1983 | Mann | 37/117.5 |
| 4,550,512 | 11/1985 | Felstet | 37/117.5 |

*Primary Examiner*—Edgar S. Burr
*Assistant Examiner*—Moshe I. Cohen
*Attorney, Agent, or Firm*—Russell L. Johnson

[57] ABSTRACT

An improved detachable tooth bar for use with excavating buckets wherein the improvements are in the provision of stops against which the lip of the bucket bears; in the positioning of the outermost tooth of the tooth bar so as to be near the corner between the lip of the bucket and the upright side of the bucket in cooperation with; the provision of a projection of the bar beyond the outside edges of the bucket serve to break up the material through which the bucket is pressed and thereby avoid the build-up of distorting forces on the bar's mounting plate and mounting plate securement means.

5 Claims, 3 Drawing Figures

QUICK TEETH BUCKET ATTACHMENT

U.S. Disclosure Document No. 147,143 filed Feb. 20, 1986 relates to this invention and is incorporated herein by reference.

FIELD OF THE INVENTION

This invention relates to an improved detachable tooth bar for excavating buckets. More particularly this invention relates to a quickly changeable highly durable tooth bar which overcomes the deficiencies found in prior art tooth bars.

BACKGROUND OF THE INVENTION

Excavating and grading often requires the loosening of compacted materials and the smoothing of the redistributed materials as a part of the same job. The breaking up of the compacted materials is facilitated by a toothed cutting edge on the excavating tool while the smoothing and grading is best accomplished by a straight cutting lip.

On large jobs a separate excavating machine can be used for each job. For smaller jobs contractors often do the best they can with one bucket or the other. Sometimes a toothed bucket is replaced with a straight cutting lip bucket after the bulk of the excavating is done and most of the remaining work is that of grading.

The notion of a quick change tooth bar attachment for straight cutting lip excavating equipment has been an appealing concept for over fifty years. To date attempts to reduce the concept to commercial practice have not been noteworthy.

The enormous forces and brutal treatment that the cutting edge of an excavating bucket receives must be dealt with in order for such a detachable tooth bar to have any hope of functional utility. In particular, the failure of prior art devices to provide a mounting scheme that will accommodate to wear on the cutting lip of the bucket and to avoid bending, distorting, or breaking of the tooth bar mount and it's fastener(s) have been a serious deficiency in prior art devices.

BRIEF DESCUSSION OF THE PRIOR ART

The prior art teaches numerous schemes for detachable mounting teeth and teeth bars to excavating buckets. The instant inventor does not claim to have invented the detachable tooth bar, but rather he claims certain novel improvements in the construction of a detachable tooth bar for excavating buckets.

The prior art devices known to the inventor which most closely relate to the instant invention are U.S. Pat. No. 3,201,972, to KERESTES and U.S. Pat. No. 2,164,988 to BIASI.

Devices such as those proposed by KERESTES and BIASI do not perform well in use. Wear of the cutting lip and deformation of the cutting lip in use make the close fit of the cutting lip in the recess of the tooth bar impossible to maintain. The result is difficulty in getting the tooth bar in place when the cutting lip of the bucket is deformed and the assuming of the entire force load on the mounting bolts when wear decreases the dimensions of the cutting edge. The bolts then frequently become deformed and their removal becomes difficult and time consuming.

These deficiencies in the prior art are overcome by the instant invention by providing the cutting lip receiving recess with stops against which the cutting lip bears thereby eliminating the need to pass bolts through the bar and the cutting lip of the bucket and to accommodate to a range of wear and cutting lip distortions.

Virtually all of the prior art devices employ nuts and bolts as means of detachable joinder. None, to the inventor's knowledge, provide adequate protection for the nuts and bolts to withstand or avoid the tremendous forces exerted on them when the bucket is pressed into densely compacted materials. As a result, breakage or irreparable deformation of such nuts and bolts is a common deficiency noted in prior art devices.

The instant invention in counterdistinction employs only two nuts and bolts as securement means. These nuts and bolts are positioned on the upright sides of the bucket. The tooth bar is configured so as to project beyond the sides of the bucket and the outermost teeth of the tooth bar are positioned as close as possible to the upright sides of the bucket. These two novel constructions serve to break up the material being excavated before it contacts the nuts and bolts and thereby eliminates the potential for the high shearing and deforming loads from compacted materials to break or deform the nuts and bolts. In addition the instant invention employs rearward extension of the tooth mounting post to deflect materials entering the bucket away from the mounting nuts and bolts. The mounting bolts of this invention serve as positional securements and are subject to very little loading.

BRIEF DESCRIPTION OF THE INVENTION

The invention in its simplest form can be described as an improved detachable tooth bar for excavating buckets wherein the improved bar can be characterized as an elongate bar having a top plate and a bottom plate and the top plate and the bottom plate are joined along one of their long edges to form a cutting edge and the top plate and the bottom plate and the cutting edge define a recess for receiving the cutting lip of an excavating bucket. The elongate bar is sized so as to project a short distance beyond the upright sides of the excavating bucket to which it is to be attached. Mounting plates are incorporated in the bar structure and project in a direction opposite the cutting edge so that the mounting plates lie along the upright sides of the bucket when the bar is in place on the cutting lip of the bucket. Cutting lip engaging stops project into the recess for receiving the cutting lip and the stops are positioned intermittently along the bar in the recess. Teeth mounting posts are incorporated into the structure of the bar and are spaced intermittantly along the bar with the outermost tooth mounting posts being positioned adjacent to and joined to the mounting plate and having an upward and rearward projection so as to break up and deflect material entering the bucket before they encounter the nuts and bolts securing the mounting plate to the upright sides of the excavating buckets.

DETAILED DESCRIPTION OF THE INVENTION

Figure 1:
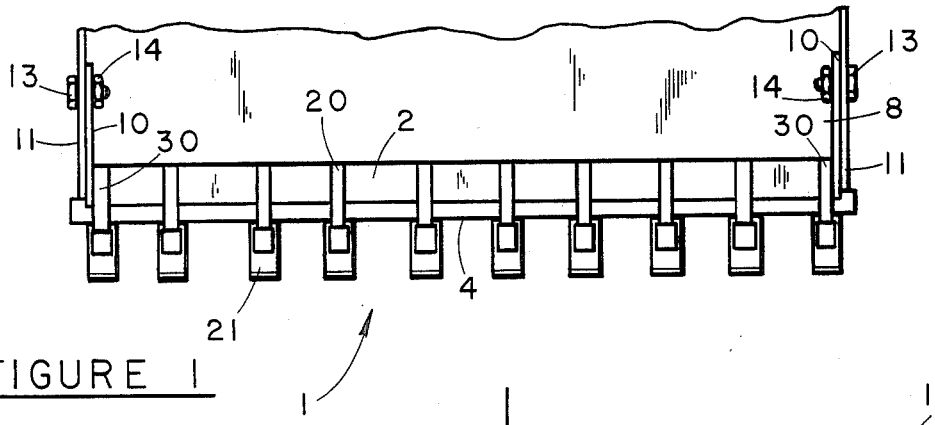
FIG. 1 is a plan view of the detachable tooth bar of this invention attached to an excavating bucket.
Figure 2:
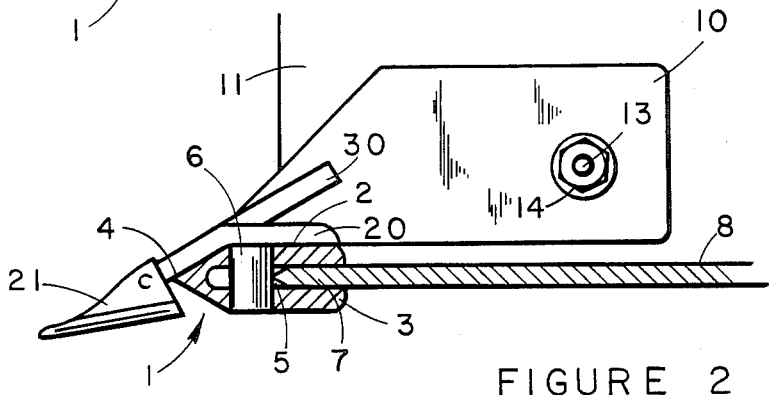
FIG. 2 is a fragmentary sectioned elevational view of the bar of FIG. 1.
Figure 3:
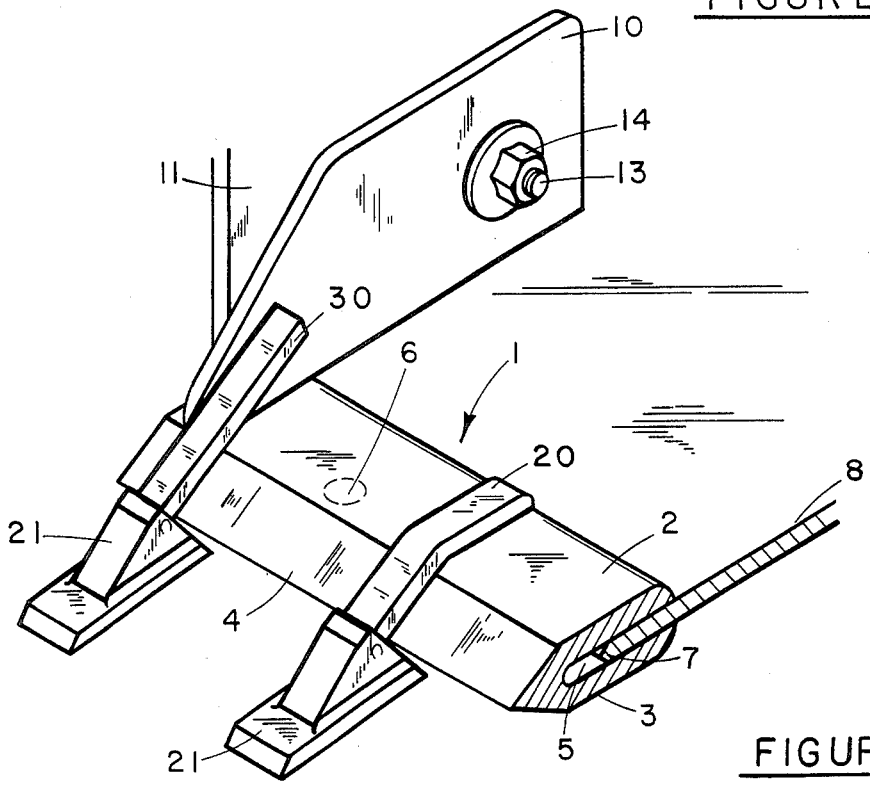
FIG. 3 is a fragmentary pictorial view of the corner details of the bar of FIGS. 1 and 2.

In the figures like numbers refer to like objects. Referring now to FIGS. 1 through 3. The improved tooth bar 1 of this invention is comprised of top plate 2 and bottom plate 3 which are joined to form cutting edge 4. Top plate 2 and bottom plate 3 and cutting edge 4 define cutting lip receiving recess 5. Stops 6 project into recess 5 and are here shown as round rods welded in place. It should be understood that bar 1 could be cast as a unit and stops 6 would then be formed as an integral part of the casting.

In use, the cutting lip 7 of excavating bucket 8 is fit into recess 5 until it engages stops 6. Stops 6 serve to transmit the force exerted upon them to plates 2 and 3 where the force is transmitted substantially parallel to the direction of the force exerted on stops 6. It should be noted that stops 6 can be cut into and otherwise significantly deformed by cutting lip 7 without impairing the functionality and utility of stops 6 or bar 1. The ability of stops 6 to sustain material deformation without loss of function or utility is in clear counterdistinction to prior art teachings wherein pins are passed through cutting lip 7 as taught for example by BIASI and by KERESTES. It should be noted also that the instant invention does not require that holes be drilled in the cutting lip 7 of bucket 8. Such holes must be cleaned of caked on and hardened material before they become usable. Construction workers have little patience with struggling to attach and remove poorly conceived of excavating attachments. It also should be noted that the cutting lip 7 of bucket 8 is subject to significant uneven wear. Therefore, it is all but impossible to transfer the load to the cutting lip once the bar is secured by bolts through the cutting lip. As a result, the load is carried by such bolts and their deformation and distortion is highly probable. The consequence is that the bolts become mishapen and their removal becomes a down time problem.

Bar 1 is secured in place by mounting plates 10 which are secured to bar 1 near but not at each end. Mounting plates 10 have passing therethrough bolt holes (not shown) which mate with bolt holes (not shown) in upright side 11 of excavating bucket 8 and bolt 13 and nut 14 secure to the mounting plate to the upright side 11.

Bar 1 projects beyond the outside edges of bucket 8 to facilitate breaking up the material passing along the outside of the bucket. This novel provision breaks up the material passing near the head of bolt 13 and thereby greatly reduces the incidences of damage and deformation to bolt 13. Further, the projection of the cutting lip beyond the edge of the bucket in cooperation with the positioning of the outermost tooth of the bar (discussed below) greatly facilitate the ease of penetration of the bucket into densely compacted materials. A projection of more than one eighth inch is of benefit and a projection in the order of ½ inch has been found to be satisfactory.

Bar 1 is provided with digging teeth wherein the outermost tooth of the bar is positioned adjacent to and secured to mounting plate 10. In the preferred embodiments, conventional tooth posts 20 are secured to bar 1 and replaceable digging teeth 21 secured to posts 20. For the outermost tooth post 30, the post is secured to mounting plate 10 by welding and post 30 is angled upward so as to break up and deflect incoming material so as to greatly reduce the potentials for damage to nut 14. The remainder of tooth posts 20 are fit along bar 1 and joined thereto. It should be noted that the outside corners of the bar and the tooth post and the mounting plate in the direction away from cutting edge 4 are curved so as to reduce the tendency of materials to become caught up when dumping materials from the bucket.

In the above detailed description the applicant has provided an enabling disclosure of the novel elements of his improved detachable tooth bar for excavating buckets. He has specifically discussed how these novel improvements overcome deficiencies found in the prior art. He has particularly pointed out the benefits of stops over bolts, the extension of the cutting edge of the bar beyond the outer edge of the bucket, the positioning of the outermost tooth on the bar as close as possible to the outside of the bucket, the use of the projection of the cutting edge and the tooth post tc break up compacted material before they encounter the mounting bolt and nut, and the like.

However, it should be understood that the scope of the invention should not be limited to the scope of the details described above but rather the scope of the invention should be limited only by the scope of the appended claims and all equivalents thereto which would become apparent to one skilled in the art.

I claim:

1. An improved detachable tooth bar for excavating buckets comprising;

(a) An elongate tooth carrying bar having a top plate and a bottom plate which are joined along one long edge to form a cutting edge and the plates and the cutting edge define a longitudinal recess in the bar and the recess conforms to the top and bottom surfaces of a cutting lip of an excavating bucket, and (b) the bar has incorporated into its structure bucket lip engaging stops which project into the recess and the stops are positioned intermittently along the length of the bar so as to be engageable with a cutting lip of an excavating bucket, and (c) the bar has mounting plates incorporated into its structure and the plates are positioned near but not at the ends of the elongate bar and project from the bar in a direction opposite the direction of the cutting edge and the mounting plates are configured so as to lie along the inside of the upright sides of an excavating bucket when the bar is engaged with the cutting lip of the excavating bucket and the mounting plates are provided with means for securing the mounting plate to the upright sides of the excavating bucket, and (d) a tooth mounting post is positioned on the tooth bar and in contact with the mounting plate at an inside intersection of the tooth bar and the mounting plate, and a tooth mounted on the post serves to break up compacted materials into which the tooth is pushed prior to the compacted materials coming into contact with the upright sides of the bucket.

2. The detachable tooth bar of claim 1 wherein the teeth are positioned intermittently along the bar and the outermost tooth at each end of the bar is located adjacent to the mounting plates so as to provide a tooth at each inside corner of the bucket when the bar is in the operating position on an excavating bucket.

3. The detachable bar of claim 2 wherein the length of the bar is such that the cutting edge projects beyond the upright sides of the excavating bucket a distance greater than $\frac{1}{8}$ inch so that the projecting ends of the bar, in operation, break a path for the upright sides of the bucket as the bucket is pressed into densely compacted material.

4. The detachable tooth bar of claim 3 wherein the mounting plate is secured to the upright side of the bucket by means of a bolt and nut and the positioning of the outermost tooth of the tooth bar acts in cooperation with the projection of the cutting edge of the bar beyond the upright sides of the bucket to break up materials through which the bucket is pressed and thereby providing a means for preventing the materials from exerting forces of disfiguring magnitude on the projections of the nut and bolt to either side of the mounting plate and upright side of the excavating bucket.

5. The detachable tooth bar of claim 4 wherein the teeth are of the replacable type and tooth mounting posts are secured to the bar and the external corners of the tooth mounting posts and the bar are curved so as to reduce the tendency of materials to become caught up on the corners when materials are passing into and out from the excavating bucket.

* * * * *